United States Patent [19]

Dobrucki et al.

[11] Patent Number: 4,602,493

[45] Date of Patent: Jul. 29, 1986

[54] ROLLING MILL FOR REDUCING THE THICKNESS OF THE WALL OF A TUBE

[75] Inventors: Władysław Dobrucki; Jerzy Mischke; Andrzej Pietrzykowski, all of Carcow, Poland

[73] Assignee: Akademia Gorniczo-Hutnicza im. Stanislawa Staszica, Cracow, Poland

[21] Appl. No.: 553,068

[22] Filed: Nov. 18, 1983

[30] Foreign Application Priority Data

Nov. 25, 1982 [PL] Poland ..... 239249

[51] Int. Cl.[4] ..... B21B 19/12

[52] U.S. Cl. ..... 72/78; 72/126

[58] Field of Search ..... 72/78, 96, 97, 95, 100, 72/208, 209, 122, 124, 126

[56] References Cited

U.S. PATENT DOCUMENTS

| | | | |
|---|---|---|---|
| 389,585 | 9/1888 | Mannesmann | 72/97 |
| 644,919 | 3/1900 | Illingworth | 72/78 |
| 1,368,413 | 2/1921 | Stiefel | 72/78 |
| 1,596,751 | 8/1926 | Millspaugh | 72/78 |
| 1,874,995 | 8/1932 | Heinauer | 72/78 |
| 1,990,607 | 2/1935 | Kocks | 72/78 |
| 2,164,724 | 7/1939 | Severin | 72/97 |
| 2,179,918 | 11/1939 | Brock | 72/97 |
| 3,503,238 | 3/1970 | Marcovitch | 72/96 |
| 3,718,020 | 2/1973 | Leitner | 72/78 |
| 3,735,617 | 5/1973 | Bretschneider | 72/78 |
| 4,212,178 | 7/1980 | Bretschneider | 72/97 |

FOREIGN PATENT DOCUMENTS

| | | | |
|---|---|---|---|
| 635015 | 9/1936 | Fed. Rep. of Germany | 72/78 |
| 2657823 | 6/1978 | Fed. Rep. of Germany . | |
| 2657839 | 6/1978 | Fed. Rep. of Germany . | |
| 1207526 | 2/1960 | France | 72/97 |
| 133761 | 1/1979 | German Democratic Rep. . | |
| 134491 | 3/1979 | German Democratic Rep. . | |
| 83997 | 9/1976 | Poland | 72/78 |

*Primary Examiner*—Lowell A. Larson

[57] ABSTRACT

A method of reducing the thickness of the wall of a tube wherein in the zone of the reduction of the wall thickness, on the internal surface of the tube the plug of a mandrel exerts a pressure causing an increase of the inner diameter, and on the external surface rolls exert a pressure securing invariability of the outer diameter of the tube.

A rolling mill for reducing the thickess of the wall of a tube comprises a extension plug (4) mounted on a mandrel (1) and working rolls (6) which in the zone of the reduction of the wall of the tube (2) have the surface of the roll face parallel to the axis of the tube (2). Bearings (7) of working rolls (6) are radially-slidably mounted in the planetary cage (8).

1 Claim, 2 Drawing Figures

ROLLING MILL FOR REDUCING THE THICKNESS OF THE WALL OF A TUBE

The subject of the present invention is a method of reducing the thickness of the wall of a tube and a rolling mill for reducing the thickness of the wall of a tube.

BACKGROUND OF THE INVENTION

A rolling mill known from German patent specification No. 635,015 has a driven back up ring enclosing rolls which driven by the friction force against the back up ring and a tube run round it with satellite motion. The tube placed on a cylindrical mandrel is pushed or pulled through the rolling mill. Rolls have such a shape and are disposed in relation to the axis of the tube so that while rolling it they reduce at the same time the outer diameter of the tube.

A disadvantage of the above described rolling mill is the loading of the tube while subjecting the same to a full rolling torque, which results from the lack of a spinning and separately driven head wherein bearings of rolls would be mounted. This causes a torsional deformation of the tube. Besides, rolls are loaded with the axial pressure force of metal.

A method of increasing the outer diameter of a tube, known from Polish patent specification No. 83,997, consists in that increasing the diameter of a tube is carried out in two stages. In the first stage through the tube an immovable extension plug is pulled or pushed. In the second stage walls of the tube are transversely rolled on the extention plug by a set of three or more rolls running round the tube with satellite motion. The relation of the angular velocity of the planetary cage and the back up ring is selected so that the torque moment acting on the tube is close to zero. A device known from Polish patent specification No. 83,997 has a mandrel fixed with one end to the body, whereas on the other end thereof a conical extension plug is situated. Around the plug three working rolls are disposed, which have the principal part of their working surface in a frustoconical shape. The rolls are mounted on bearings immovably or in a self-aligning manner in the planetary cage and supported by the back up ring connected with a power transmission system. The back up ring drives working rolls and—by supporting them—reduces their deflection. The planetary cage is connected with a separate power transmission system, whereby both power transmission systems allow such an adjustment of their angular velocities so that the torsional moment acting on the tube oscillates near zero. Axes of working rolls lie on the surface of the cone having the top situated in line with the axis of the tube and directed opposite to the direction of its movement. The tube is surrounded by a set of push-in rolls having axes perpendicular to the axis of the tube.

A disadvantage of the above described method and device is a considerable limitation of possibilities of producing tubes with a small diameter and a thin wall, resulting from the limitation of the value of elongation and the association of the reduction of the thickness of the wall with the enlargement of the diameter. The thickness of the rolled tube depends on the position of the extension plug in relation to the rolls. As a result of insufficient rigidity of the rolling mill in the direction of its axis there are difficulties in obtaining high accuracy of the thickness of the wall of the tube. Besides, axial bearings of rolls of the said rolling mill are loaded with the pressure of metal having a considerable value, which has a disadvantageous effect on their life.

SUMMARY OF THE INVENTION

The object of the present invention is to work out a method and to design a rolling mill enabling reduction of the thickness of the wall of a tube of an unrestrictedly big diameter, while increasing accuracy of dimensions and the shape of the tube.

This object has been achieved due to the fact that in joint processes of rotary rolling and push-broaching or broaching of the tube, in the zone of reducing the thickness of the wall, The extension plug of the tube enlarges the inner diameter of the tube, whereas the rolls revolving around the tube keep the outer diameter constant.

The rolling mill according to the invention has a mandrel fixed with one end to a body, whereas on the other end thereof a extension plug is situated, around which working rolls are disposed, said rolls being mounted on bearings in a driven planetery cage and supported by a back up ring connected with a power transmission system. At one side of the planetary cage a push-in unit is disposed and at the other side a pull-out unit. Axes of the working rolls are parallel to the axis of the tube and the surface of the roll faces of the rolls in parallel to the axis of the tube in the zone of reduction of the wall of the tube. Bearings of working rolls are radially and-slidably mounted in the spinning head and unbounded by the planetary cage in their radial movement.

An advantage of the method according to the invention is that the degree of the reduction of the wall thickness is made independent of the change of the outer diameter of the tube, in the rolling zone. The application of rolls with parallel axes and the surface of the roll face parallel to the axis of the tube without a groove or a projection in the zone of reduction of the tube wall causes the elimination of the axial component of the pressure of metal, reduces the pressure on bearings and enables increasing the axial rigidity of the rolling mill by means of supporting the rolls with a rigid back up ring. At the same this makes the thickness of the tube wall independent of changes of the axial position of the head in relation to the rolls, caused by elastic deformation of the elements of the rolling mill in the axial direction. The load applied on a single roll does not depend on the diameter of the tube, and, thus, an increase of the rate of travel of the tube together with the diameter thereof is possible. Moreover, during rolling all elements of the rolling mill move with a uniform motion, whereby the tube does not spin around which makes it possible to lower the noise level, to reduce the power consumption and to prolong the life of the rolling mill.

BRIEF DESCRIPTION OF THE DRAWING

The subject of the invention is presented in an example of a preferred embodiment in the drawing in which.

DESCRIPTION OF THE PREFERRED EMBODIMENT

Figure 1:
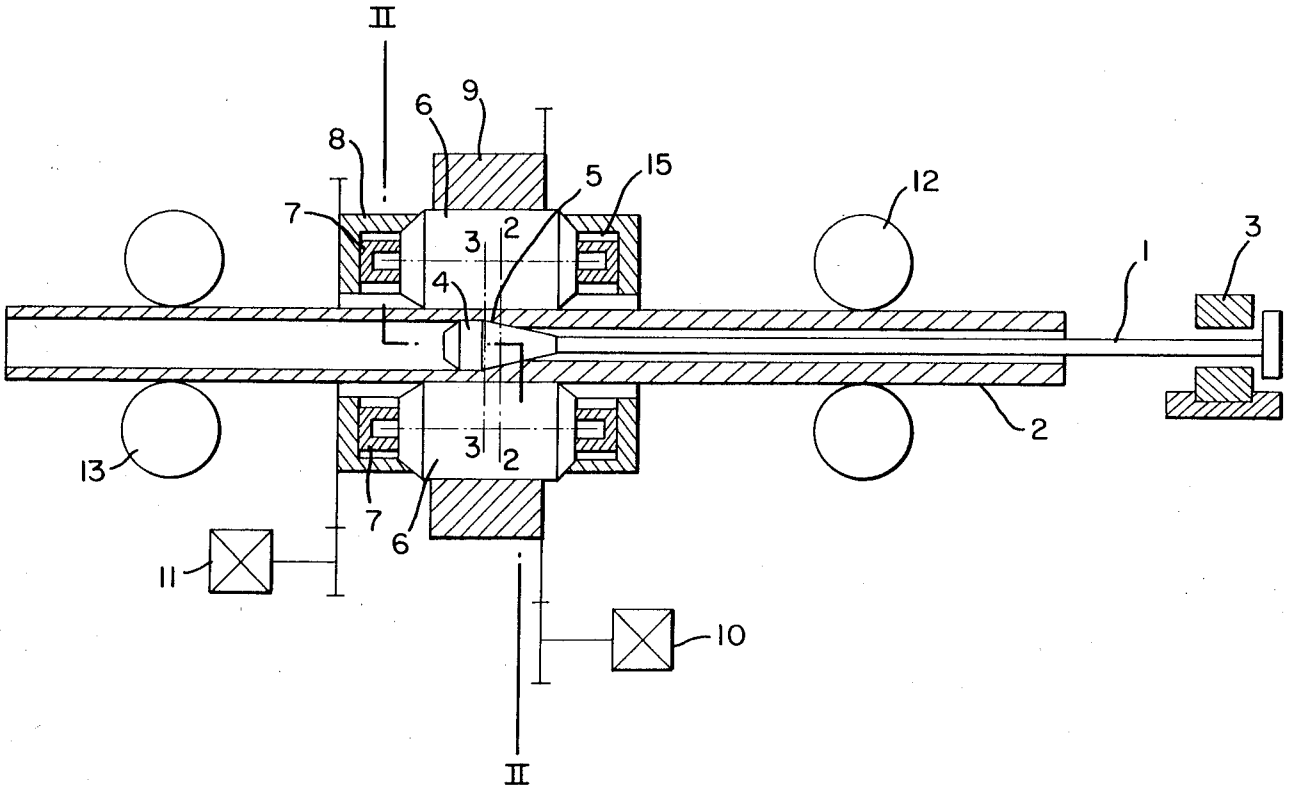
FIG. 1 shows the diagram of the rolling mill in axial section, and FIG. 2—the rolling mill in taken along line A—A of FIG. 1.
Figure 2:
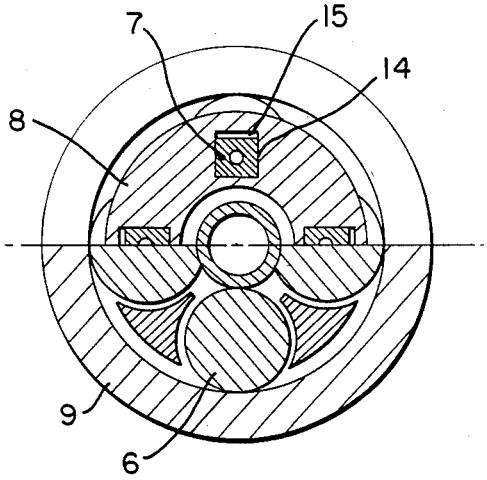

The rolling mill according to the invention has a mandrel 1 over which a tube 2 is passed. The mandrel 1 is fixed with one end to the body 3 and on the other end thereof a plug 4 is situated, plug 4 having a diameter increasing in the direction of the movement of the tube 2 (from right to left in FIG. 1). Around the plug 4 four working rolls 6 are disposed, which have axes and faces parallel to the axis of the tube 2 in the zone of reduction 5 of the wall thickness defined by planes 2—2, 3—3 in FIG. 1, Rolls 6 are mounted in bearings 7 whose housings are radially and-slidably disposed in a planetary cage 8. Between the bearings 7 and the planetary cage 8 slots 15 are provided to prevent any contact of housing 7 and cage 8 in possible radial movement of housing 7 along way 14. Said rolls are supported by a back up ring 9 connected with a power transmission system 10. The cage 8 is connected with a separate power transmission system 11, whereby power transmission systems 10 and 11 enable such adjusting of their driving torques so that the torsional moment acting on the tube 2 is comprised within pre-set limits, for example, is equal to zero. Before rolls 6 a push-in unit 12 is situated and behind rolls 6 a pull-out unit 13.

The method of reducing the thickness of the tube wall consists in that a tube 2 having nominal dimensions, made of carbon steel, is placed on the mandrel 1, and pushed over the plug 4 having a diameter increasing from 56 mm to 69 mm, by means of the push-in unit 12. The tube 2 while widening on the plug 4 contacts the rolls 6 with a diameter of 50 mm and from this moment the reduction of the wall thickness starts by widening the inner diameter and maintenance of a constant outer diameter of the tube 2 between the conical part of plug 4 in the zone of reduction 5 thereby reducing the wall in cooperation with rolls 6 which transversely roll the tube 2 while moving the tube in the axial direction, running around it in satellite motion. After the wall of the tube 2 leaves the reducing zone 5. reducing the wall, the tube 2 has the nominal dimensions 75×3 mm. The tube 2 is further processed to the desired size by the remaining part of the working part of the rolls 6. This part of the roll 6 has a diameter equal to the diameter of roll 6 inside of reduction zone 5. As a result thereof the tube 2 gets smoothness of the external surface corresponding to the smoothness achieved in grinding processes and the accuracy of the outer diameter within the limits of ±0.05 mm. The end of the tube 2 is pushed out from rolls 6 by a push-in unit 12 or pulled out by a pull-out unit.

What is claimed is:

1. A rolling mill for reducing the thickness of the wall of a tube comprising a body provided with a mandrel affixed thereto at one end of said mandrel, the other end of said mandrel being provided with a plug of frustoconical shape for increasing the inner diameter of a tube to be forced thereover, said mandrel having a longitudinal axis, a plurality of rollers surrounding said plug, each roller having a contact surface that contacts the tube over a contact zone with said roller contact surfaces each being cylindrical over the entire zone of contact between the roller and the tube, said rollers each being oriented to be parallel to the longitudinal axis of the mandrel for substantially reducing the axial thrust on said rollers, bearing means extending essentially parallel to the longitudinal axis of the mandrel for mounting said rollers, planetary cage means surrounding said plug for mounting said bearing means, said bearing means being movable radially within said cage means an annular rotatable back-up ring surrounding and radially supporting said plurality of rollers within said cage means, and means to rotate said back-up ring, said cage and said rollers in a plane which is oriented at a right angle with respect to the mandrel longitudinal axis so that said rollers move around the tube in a planetary motion, means to advance said tube onto said plug to expand the inner diameter of said tube and means to withdraw said tube from said rolling mill, said rollers and said plug being so arranged as to create a zone of reduction of said tube while maintaining constant pressure in said zone on the outside of said tube, the surfaces of said rollers being parallel to the axis of said mandrel, whereby to produce a tube of reduced wall thickness and uniformly increased diameter.

* * * * *